US005188071A

United States Patent [19]

Han

[11] Patent Number: 5,188,071

[45] Date of Patent: Feb. 23, 1993

[54] CYLINDER BLOCK STRUCTURE

[75] Inventor: Ki B. Han, Suwon, Rep. of Korea

[73] Assignee: Hyundai Motor Company, Seoul, Rep. of Korea

[21] Appl. No.: 826,122

[22] Filed: Jan. 27, 1992

[51] Int. Cl.[5] ..... F02F 7/00

[52] U.S. Cl. ..... 123/195 R; 123/41.79; 164/34; 164/98

[58] Field of Search ..... 123/41.74, 41.79, 195 R; 164/34, 98, 108

[56] References Cited

U.S. PATENT DOCUMENTS 4,794,884 1/1989 Hilker et al. ..... 123/41.79

*Primary Examiner*—Noah P. Kamen

*Attorney, Agent, or Firm*—Kane, Dalsimer, Sullivan, Kurucz, Levy, Eisele and Richard

[57] ABSTRACT

In the Siamese type cylinder block structure, a hollow member having a number of arc guide pieces on both ends is inserted into the upper end between neighboring cylinder bores so as to form a cooling water passage by burying both ends of hollow member in the water jacket core. Insert pins inserted in the guide pieces at both ends of said hollow member communicating with said water jackets to prevent grains of sand injected at high pressure when a water jacket core is manufactured.

7 Claims, 4 Drawing Sheets

CYLINDER BLOCK STRUCTURE

BACKGROUND OF THE INVENTION

1. Field of the invention

The present invention relates to cylinder block structure and particularly to cylinder block structure which forms a cooling water passage so as to introduce cooling water into the inside by inserting a hollow member having arc guide pieces into the upper end between the cylinder bores and thereby cools the upper ends of cylinder bores uniformly and minimizes thermal distortion of those parts for improvement of its durability in the Siamese type cylinder block.

2. Description of the prior art

The usual Siamese type cylinder block is a cylinder block which minimizes its length by minimizing a space between the cylinder bores to reduce its weight.

In said cylinder block, there is no cooling water passage formed between the cylinder bores adjoining each other. So, if the cylinder block is heated by the heat inevitably generated when the engine operates, it is apt to be distorted by a disparity of thermal expansion between a space portion of cylinder bores without a cooling water passage and an external portion of cylinder bores with a cooling water passage. If cylinder bores are thereby distorted, the piston ring united with the upper side of the piston which reciprocates upward and downward within the cylinder does not uniformly seal to the cylinder wall but partially stick thereto, and loosely adhering phenomenon is thereby presented between them.

Moreover, in casting a Siamese type cylinder block, there is no sand supported between the cylinder bores in the water jacket core by a sand mold. So its rigidity is apt to be weakened and damaged. When cast, it is distorted so that the wall thickness bore cannot be of precise.

In order to solve such problems as stated hereinabove, various methods for improving cooling effects by froming a cooling water passage between the cylinder bores so as to enable cooling water to pass therethrough have been suggested.

One form of those conventional cylinder block structures is a method in which a cooling water passage is formed between the cylinder bores by using a ceramic core. The method for casting a cylinder block by interposing an expensive ceramic core between the neighboring cylinder bores when a cast cylinder block is manufactured and forming a cooling water passage communicating with the left and right water jackets between the cylinder bores is known.

However, this method involves a problem in that it is uneconomical because the ceramic core itself is very expensive and that it is difficult to insert and fix the ceramic core when a cylinder block is founded.

Another method is a method in which a cooling water passage is formed between the cylinder bores by giving a slope thereto with a drill, as described in the U.S. Pat. No. 4,369,739. The method for forming a cooling water passage with a drill at an incline of 20–30 degrees from the upper part of cylinder block after casting is completed is known.

However, such a method meets a problem in that drilling work is not only difficult and complicated but also uneconomical because drills are cut damaged so often and that the cooling water passage is unable to serve as such when a cut damaged drill gets caught in the cylinder block.

Although the method for forming a cooling water passage between the cylinder bores of a molded cylinder block with a side cutter is known, it still runs into a problem in that forming of the cooling water passage by processing a molded cylinder block with a separate side cutter requires so greater care that work efficiency lowers.

The U.S. Pat. No. 4,470,376 discloses a cylinder block wherein a cooling water passage is formed by inserting a reinforced plate member with a number of openings formed between the cylinder bores and linking it to the outer walls of water jackets, but it encounters a problem in that it is liable to move when cast because its uniting rigidity with the water jacket core is not so solid.

Another conventional art uses a steel bar to keep the water jacket core from being distorted in the Siamese type cylinder block. Although a steel bar with both ends bending upward is inserted between the bores of water jacket core when it is molded with the water jacket core, it is apt to move when high-pressure sand is injected in the process of manufacturing a water jacket core. Moreover, a steel plate is inserted between the bores of water jacket core when a water jacket core is molded, but it is liable to move when the water jacket core is manufactured because its uniting rigidity with the water jacket is not so solid, and the sand weakly united with the steel bar or steel plate is separated therefrom when cast and disturbs the flow of cooling water by being united with melted iron.

According to those methods described hereinabove, a cylinder block is cast by using a separate core and then the core must be taken out or a cooling water passage must be formed with a separate implement after a cylinder block is cast. Consequently, those methods are uneconomical not only for the reason that durability of the cylinder block is weakened and inferior cylinder blocks are produced in many cases but also for the reason that the cooling water passage is not precise, and so manpower and time are wasted to a considerable degree. Moreover, use of an expensive core raises manufacturing cost.

SUMMARY OF THE INVENTION

It is therfore a main object of the present invention to provide cylinder block structure wherein the upper end of cylinder bore is uniformly cooled by preventing the water jacket core from being transformed when a cylinder block is cast and forcibly changing the partial flow of cooling water when cooling water circulates the water jacket and thermal distortion of that part is thereby minimized and durability of cylinder block is accordingly improved.

Another object of the present invention is to prevent grains of sand which are injected when the water jacket core is manufactured from flowing into a hollow member by inserting insert pins which are heat-resistant at 200° C.–1400° C. into the hollow member located between the bores within the water jacket core, to easily form a cooling water passage within the hollow member by causing said insert pins to be destroyed by heat when founded and to enable the primary function of hollow member to be performed faithfully after the cylinder block is cast.

The main object of the present invention can be attained when such a cooling water passage is formed by inserting a hollow member with both ends communicating with the water jackets between the cylinder bores adjoining each other and the water jacket core is kept from being distorted by burying both ends of said hollow member therein when the cylinder block is cast and arc guide pieces are formed so as to change the flow of cooling water by becoming guide pieces after sand is removed.

BRIEF DESCRIPTION OF THE DRAWINGS

The present invention will be understood more easily by detailed description and drawings of the preferred embodiment.

DESCRIPTION OF THE PREFERRED EMBODIMENT

In the cylinder bore(9), a number of bores (11)(11') . . . are contiguous to one another and water jackets (10)(10') are formed in the circumference of cylinder bores (11)(11') . . .

A hollow member(1) is located at the upper end of a wall part between the cylinder bores(11)(11') and both ends of the hollow member(1) communicate with the water jackets(10)(10').

Figure 1:
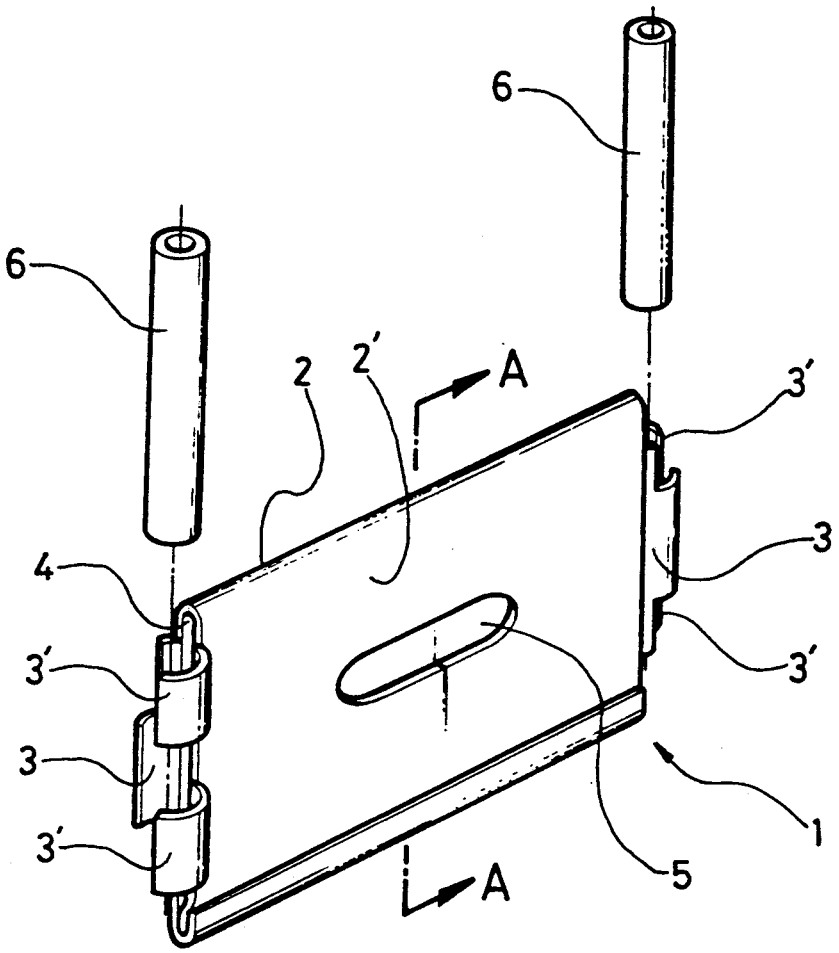
FIG. 1 is a perspective view of a hollow member and insert pins according to the present invention.
Figure 3:
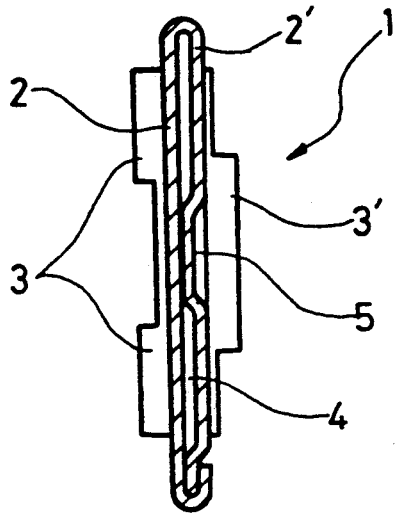
FIG. 3 is a cross-sectional view taken along the line A—A of FIG. 1.
Figure 4:
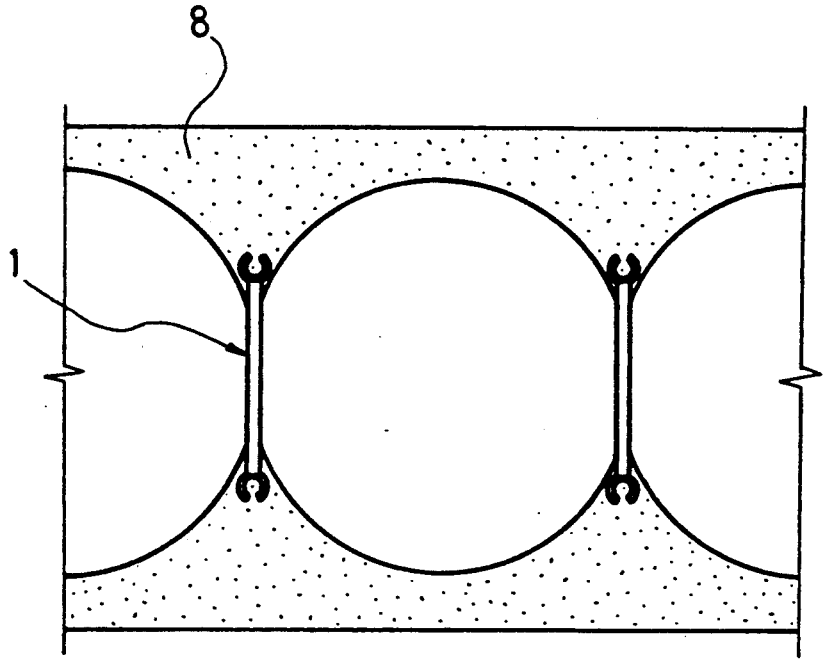
FIG. 4 is a plane view showing that hollow members are inserted in the water jacket core.

As illustrated in FIG. 1 and FIG. 3, the hollow member(1) maintains its own shape firmly by bending a plate-shaped member somewhat long so that a cooling water passage may be formed in the inner side, and bending upward the end of one wall(2) and then inserting the end of other wall(2') thereinto.

Moreover, in order to prevent both walls (2)(2') from being transformed due to intense heat generated when melted iron is poured, a concave part(5) is formed in the middle of other wall(2') to weld both walls (2)(2') by spot weld. At both ends of hollow member which communicate with the water jackets(10)(10'), a number of arc guide pieces(3)(3') which can prevent distortion by being buried in the water jacket core(8) and change the flow of cooling water by becoming concave guide pieces after sand is removed are formed as one body.

The are guide pieces(3)(3') which are formed at both ends of hollow member(1) as described hereinabove are formed in a manner that more than one guide piece(3) are formed on the one wall(2) and more than one guide piece(3') are formed on the other wall(2') and guide pieces(3)(3') are formed on the rear side so as to be symmetrical to those aforementioned when looked at from the front of the drawings.

After the hollow member(1) wherein insert pins(6) which are made of compressed material like paper or styrofoam, hear-reasistant at 200° C. to 1400° C. and burn or melt at a metal melting temperature are inserted into those guide pieces(3)(3') formed in such a manner is interposed in a water jacket core manufacturing mold, grains of sand are injected at high pressure.

Grains of sand are intercepted by the insert pins(6) and are thereby kept from flowing into the hollow member(1) and a water jacket core(8) is formed by the injected sand in such a condition.

Next, when melted iron is injected, the hollow member(1) is conglutingated with the melted iron of cylinder block(9) and buried in the upper end of the wall part between the cylinder bores (11)(11').

After casting, the insert pins(6) cease to exist due to melted iron temperature and the hollow member(1) forms a cooling water passage(4) which communicates with the water jackets(10)(10').

Figure 2:
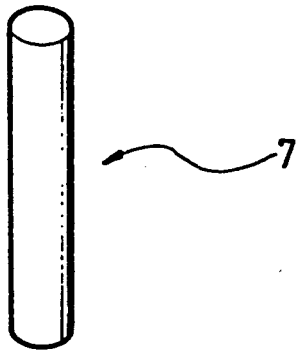
FIG. 2 is a perspective view of a substantial insert pin according to the present invention.

In the present onvention, it is proper that the shape of insert pins(6) within the guide pieces(3)(3') formed in the hollow member(1) is hollow as illustrated in FIG. 1 or substantial as illustrated in FIG. 2.

In founding a cylinder block by using the hollow member(1) formed in such a manner, when the water jacket core(8) of cylinder block(9) is manufactured, the water jacket core(8) is manufactured in a condition where the guide pieces(3)(3') formed at both ends of hollow member(1) are inserted into the upper end between the water jacket core manufacturing molds so as to be buried into the water jacket core(8). Thereafter, if melted iron is injected by a usual method, the hollow member(1) is conglutinated with the melted iron of cylinder block(9) and buried in the upper end of the wall part between the cylinder bores(11)(11').

In the process of melted iron injection as stated above, the guide pieces(3)(3') at both ends of hollow member(1) are being buried into the water jacket core(8).

Thus, the water jacket core(8) is kept from being transformed and a precise cylinder block casting is thereby obtainable.

Figure 5:
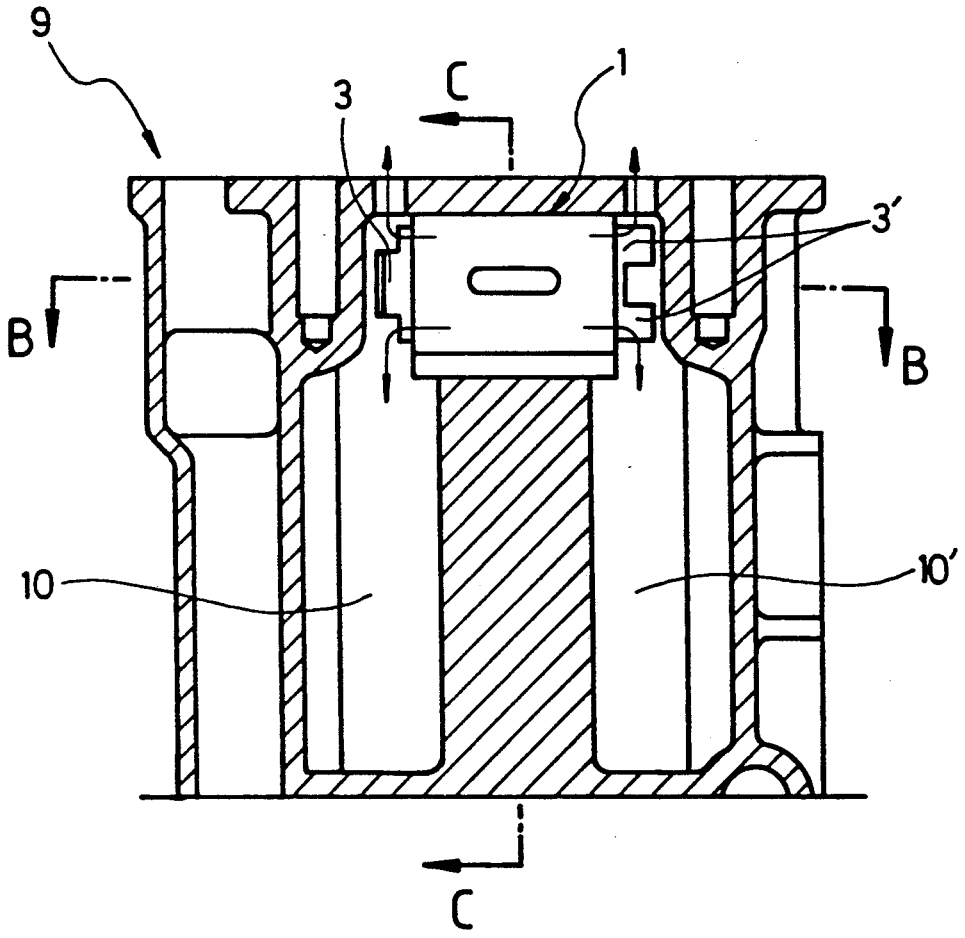
FIG. 5 is a cross-sectional view of a cylinder block according to the present invention.
Figure 6:
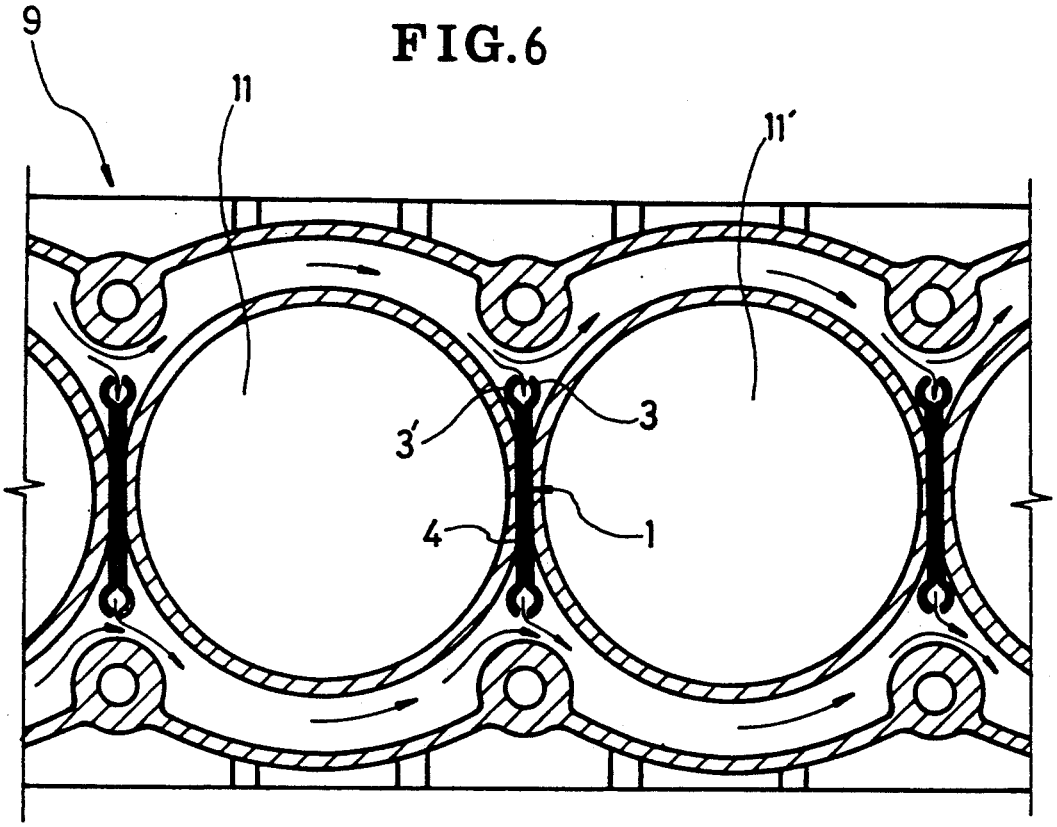
FIG. 6 is a cross-sectional view taken along the line B—B of FIG. 5.
Figure 7:
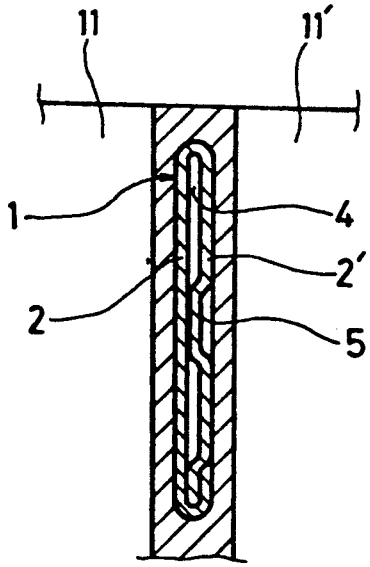
FIG. 7 is a cross-sectional view of a hollow member taken along the line C—C of FIG. 5.

When the casting sand of water jacket core(8) and the like is removed after founding is finished by said process, a cylinder block(9) is completed as illustrated in FIG. 5 and FIG. 6. Regarding the flow of cooling water in said cylinder block(9), cooled cooling water from the radiator is supplied to the water jackets(10)(10') by a water pump and circulates in the water jackets and the cylinder block is thereby cooled.

In the cooling process of such a cylinder block(9), both ends of the hollow member(1) which forms a cooling water passage(4) between the cylinder bores(11)(11') form thereon those guide pieces(3)(3') which can serve as concave guide pieces in a condition where they communicate with the water jackets(10)(10'). As illustrated in FIG. 6, some cooling water is forcibly guided to the cooling water passage(4) by the guide pieces(3)(3') and cooling of this part can be thereby achieved uniformly.

As heretofore described, when a cylinder block(9) is founded, the present invention prevents grains of sand from getting mixed into a hollow member(1) by inserting insert pins(6) in the guide pieces(3)(3') of hollow member(1) and, at the same time, prevents the water jacket core(8) from being distorted by burying both ends of hollow member(1) therein, so that a cooling water passage is easily, formed and intense heat between the cylinder bores(11)(11') which poses a problem to the cylinder block is uniformly cooled.

Therefore, the present invention is an economical contrivance which minimizes the thermal distortion of cyliner bores(11)(11') and reduces oil consumption by sticking a piston ring fast to the inside wall of cylinder.

It is understood that the same is not limited thereto but is susceptible of numerous changes and modifications as known to a person skilled in the art without departing from the spirit and scope of the invention as set forth in the appended claims.

What is claimed is:

1. Cylinder block structure comprising:

a body with a number of cylinder bores arranged immediately adjacent to one another and an upper end;

water jackets with cores arranged in said body on the left and right sides of said cylinder bores;

a hollow member having a number of arc guide pieces on both ends inserted into said upper end between said cylinder bores so as to form a cooling water passage by burying both ends of said hollow member in one of said water jacket cores; and insert pins inserted in the guide pieces at both ends of said hollow member communicating with said water jackets to prevent grains of sand from flowing into said hollow member when said one water jacket core is manufactured.

2. The cylinder block structure according to claim 1, wherein said hollow member is formed by bending an elongated element with a first and a second wall to define a cooling water passage in an inner side, and bending upward the end of said first wall and then securing the end of the said second wall to the end of said first wall to prevent said walls from being distorted by intense heat; wherein a concave part is formed in the middle of said second wall to weld said walls by spot weld.

3. The cylinder block structure according to claim 1 or claim 2, wherein more than one arc guide pieces are formed symmetrically at both ends of said hollow member are formed.

4. The cylinder block structure according to claim 1, wherein said insert pins when casting are made of a material which is heat resistant at 700° to 1400° C. and disintegrates at a temperature above 1400° C.

5. The cylinder block structure according to claim 1, wherein said insert pins are made of compressed material selected from a group consisting of paper and styrofoam.

6. The cylinder block structure according to claim 1, wherein said pins are hollow.

7. The cylindrical structure of claim 1 wherein said pins are solid.

* * * * *